United States Patent [19]

Weidner

[11] 4,280,410

[45] Jul. 28, 1981

[54] ELECTRICAL PROJECTILE DETONATOR

[75] Inventor: Peter Weidner, Breitenbrunn, Fed. Rep. of Germany

[73] Assignee: Diehl GmbH & Co., Fed. Rep. of Germany

[21] Appl. No.: 85,463

[22] Filed: Oct. 17, 1979

[30] Foreign Application Priority Data

Nov. 2, 1978 [DE] Fed. Rep. of Germany ..... 2847548

[51] Int. Cl.[3] ..... F42C 11/02

[52] U.S. Cl. ..... 102/210; 102/513

[58] Field of Search ..... 102/210, 60, 87

[56] References Cited

U.S. PATENT DOCUMENTS

| | | | |
|---|---|---|---|
| 3,101,054 | 8/1963 | Stevenson et al. | 102/210 |
| 3,967,141 | 6/1976 | Gawlick et al. | 102/210 |

FOREIGN PATENT DOCUMENTS

| | | | |
|---|---|---|---|
| 2206646 | 8/1972 | Fed. Rep. of Germany | 102/210 |
| 2746599 | 4/1979 | Fed. Rep. of Germany | 102/210 |

*Primary Examiner*—Charles T. Jordan

*Attorney, Agent, or Firm*—Scully, Scott, Murphy & Presser

[57] ABSTRACT

An electrical projectile detonator, particularly a base detonator, containing a piezoceramic cell as a current generator. The cell is retained against the inside of the projectile base or base screw. A rupture plate is positioned on the outside of the base at a predetermined spacing from the cell. The rupture plate is adapted to be disintegrated by the gas pressure of the projectile propellent charge to thereby produce a shock wave in the projectile base. This shock wave propagates within the projectile and loads the piezoceramic cell so as to generate a voltage in the cell.

8 Claims, 5 Drawing Figures

ELECTRICAL PROJECTILE DETONATOR

BACKGROUND OF THE INVENTION

1. Field of the Invention

The present invention relates to an electrical projectile detonator, in particular a base detonator, which includes a piezoceramic cell forming a current generator in which a voltage can be generated through the gas pressure of a pyrotechnic charge.

2. Discussion of the Prior Art

In electrical projectile detonators which include a piezoceramic cell as a current generator, the cell is mostly so arranged that, either at firing under the effect of inertial forces, or at impact against a target it is exposed to a pressure load or impact load and, as a result, electrical energy is generated therein which is necessary for the detonation of the explosive charge. For this purpose, the cell is arranged either in the tip of the projectile or in the base thereof.

In addition to the foregoing, it has also become known from German Laid-Open Patent application Ser. No. 22 06 646 that the mechanical pressure energy which is required for the generation of the electrical energy can be generated through the intermediary of a pyrotechnic charge.

While the forces which occur during the firing acceleration are sufficient to generate the voltage required for detonation in a piezoceramic cell, this energy is frequently inadequate to concurrently supply occasionally additional electrical circuits which may be present in the detonator. On the other hand, a current source as disclosed in the above-mentioned German patent application requires its own pyrotechnic charge, as well as an auxiliary detonator arrangement.

Consequently, it has already been previously proposed in German Patent application No. P 27 46 599.2 to load or charge a piezoceramic cell in an electrical projectile detonator through the gas pressure of the projectile propellent charge. In accordance with this proposal, the piezoceramic cell is arranged within a recess on the outside of the projectile tail and is covered by a pressure plate which is pressed against the piezoceramic cell by the gas pressure of the projectile propellent charge.

Through this arrangement there is obtained a piezoceramic current generator whose output lies considerably above those of the piezoceramic current generators which operate under inertial force. The thus generated electrical energy is conducted through gas-tight conduit passageways towards the electronic power storage circuitry which is positioned interiorly of the projectile. Hereby, the passageways which extend through the projectile base set relatively high constructional demands on the projectile since they must be able to withstand the propellent charge pressure and dependably prevent penetration of the propellent charge gases into the interior of the projectile. This, however, is decisive for the unarmed condition of the detonator of the projectile which equipped with an electrical projectile detonator of that type.

SUMMARY OF THE INVENTION

Accordingly, it is an object of the present invention to so construct the current generator of an electrical projectile detonator of the above-mentioned type wherein it will provide the same output as the previously described arrangement but which, form a constructional standpoint, will provide a greater degree of safety of the unarmed detonator at a concurrently greatly reduced constructional demand.

The foregoing object is achieved through the present invention in that, for a projectile detonator of this type, it contemplates the piezoceramic cell to be supported so as to be maintained in contact with the interior of the projectile base or, respectively, a base screw, and that on the exterior of the projectile base or a base screw and at a distance to the former there is arranged a rupture plate which is adapted to be loaded by the gas pressure of the projectile propellent charge, and through the intermediary thereof will at its bursting generate a shock wave in the projectile base or base screw for the excitation of the piezoceramic cell.

Through the inventive arrangement it is possible to concurrently employ the projectile propellent charge for also the generation of electrical energy by means of a piezo-generator without necessitating the incorporation of additional measures for assuring the unarmed safety of the detonator. Hereby, in that the piezoceramic cell is not directly excited through the increase in the gas pressure, but with the aid of the rupture plate this pressure is converted into a shock wave, there is additionally obtained a surprising increase in the energy yield. This can be traced back to that the pressure increase which is fully developed over a millisecond range, but the significantly shorter shock will effect the compression of the piezoceramic cell upon the bursting of the rupture plate. It is thereby possible, without any further measures, to arrange a plurality of that type of cells behind each other in the interior of the projectile so as to be able to again increase the energy yield. Inasmuch as the piezo-ceramic cell in the preferred embodiment of the inventive projectile detonator is positioned intermediate the projectile base or the base screw and an intermediate bottom which is fixed in and preferably screwed into the projectile, the cell is protected against an undesired loading. This will concurrently impart a high degree of safety to the inventive detonator during handling and operation thereof.

In an advantageous embodiment of the projectile detonator pursuant to the invention, the rupture plate is arranged within a cup-shaped recess formed in the base of the projectile and is thus extensively protected against premature damages. This also leads to a further increase in the operational safety, such as through an arrangement of pressure-balancing apertures of small cross-section which will prevent the possible build-up of an air cushion between the rupture plate and the base of the projectile.

In preferred embodiments of the inventive projectile detonator, the latter has particularly advantageous utilization in tracer projectiles.

BRIEF DESCRIPTION OF THE DRAWINGS

References may now be had to the following detailed description of preferred embodiments of the invention, taken in conjunction with the accompanying drawings; in which.

DETAILED DESCRIPTION

Figure 1:
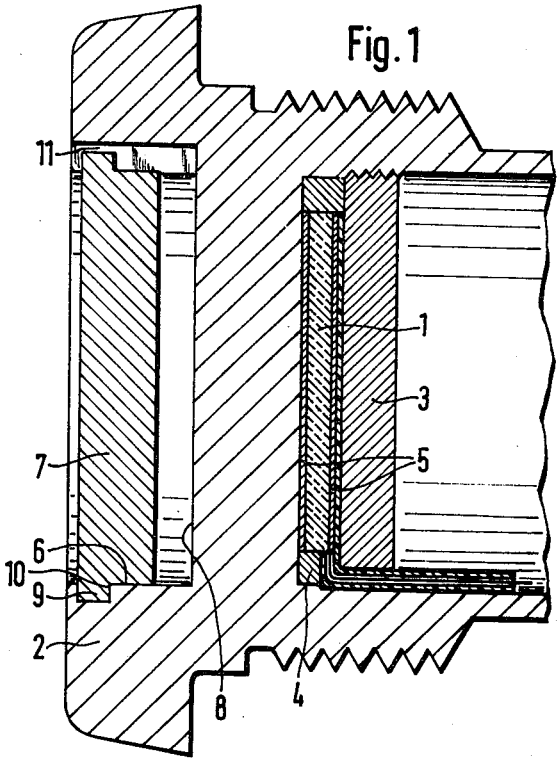
FIG. 1 is a longitudinal section through the base screw of a projectile, which contains a base detonator with a piezoelectric current generator pursuant to the invention.

In the various figures of the drawings the same or similar components are identified by the same reference numerals.

According to FIG. 1, a plate-like piezo-ceramic cell of a base detonator is so built into the base of the projectile, which formed by means of a base screw 2, as to have one surface solidly contact the interior surface thereof. The piezoceramic cell, in the herein illustrated embodiment, is maintained in its position by an intermediate bottom 3 screwed into the base screw, as well as by a ring 4 which is constituted of an insulating material. Furthermore, the cell 1 is provided with connector lugs or contacts 5 of which one is directly connected with the base screw, whereas the other one is insulatedly conducted to an electronic power storage circuit (not shown).

Figure 2:
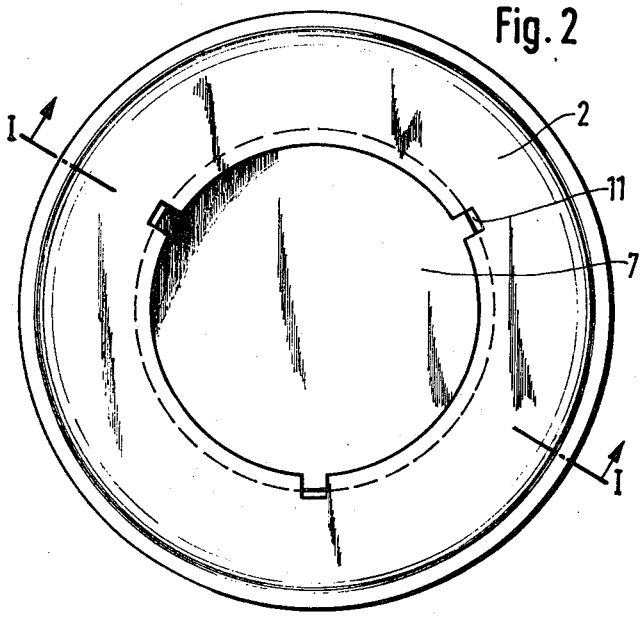
FIG. 2 is a plan view of the base screw illustrated in FIG. 1.

A rupture plate 7 is arranged on the exterior of the base screw 2 within a cup-shaped recess 6, and in essence at a distance with respect to the bottom surface 8 of the recess 6. The rupture plate 7 hereby lies in contact through an annular projection 9 against an annular shoulder 10 of the recess 6 and is fixed in this position through flanging. Finally, in the herein illustrated embodiment, the recess 6 is provided with pressure-balancing apertures 11 which consists of radially extending notches of small cross-section formed in the wall surface of the recess 6. The pressure-balancing apertures 11, as illustrated in FIG. 2 of the drawings, are arranged equidistantly about the periphery of the recess 6.

At the firing of the projectile propellent charge, which is not shown in the drawings, after the air pressure which is being built up in the propellent charge chamber has reached a threshold value which is predetermined by the strength of the rupture plate 7, the rupture plate will disintegrate. The thus produced concussion of the projectile base produces a shock wave which traverses the former and which, at its interior, will excite the piezoceramic cell 1. Hereby the pressure-balancing apertures 11 will assure that no air cushion will be generated intermediate the rupture plate 7 and the bottom surface 8 in the recess 6 which would hinder the impact-like disintegration of the rupture plate and which can reduce the energy yield. The charge which, in this manner is generated in the piezoceramic cell is tapped off through contacts 5 and conducted to the electronic power storage circuit.

Figure 3:
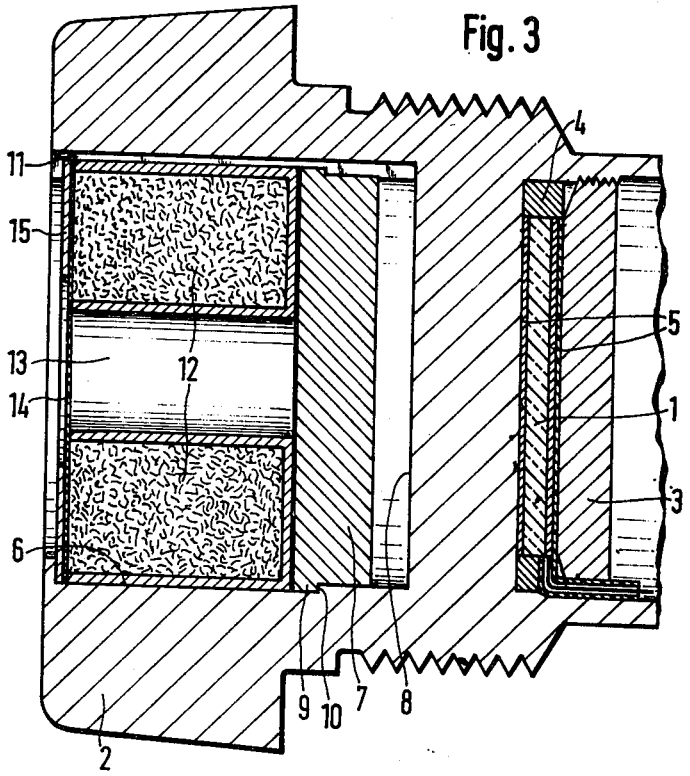
FIG. 3 is a longitudinal section through the corresponding base screw of a tracer projectile.

Pursuant to FIG. 3, in the cup-shaped recess 6 there is additionally located a luminescent tracer composition 12. This is provided with a through-extending central bore 13 by means of which the rupture plate 7 can be connected with the propellent charge chamber. The side of the luminescent tracer composition 12 facing towards the side of the propellent charge chamber is herewith covered by a metal foil 14 which, initially, also extends over the central bore 13. The rearward closure of the luminescent tracer composition 12 is formed by a perforated disc 15.

At its other side, the luminescent tracer composition 12, which is retained at the tail end by an inward flanging, is positioned against the rupture plate 7 and presses the latter through its projection 9 against the annular shoulder 10.

The propellent charge gases which are required for the loading of the rupture plate 7, in the herein illustrated embodiment, pass through the central bore 13 of the luminescent tracer composition 12 against the ruptured plate after they have previously pushed through the metal foil 14.

Figure 4:
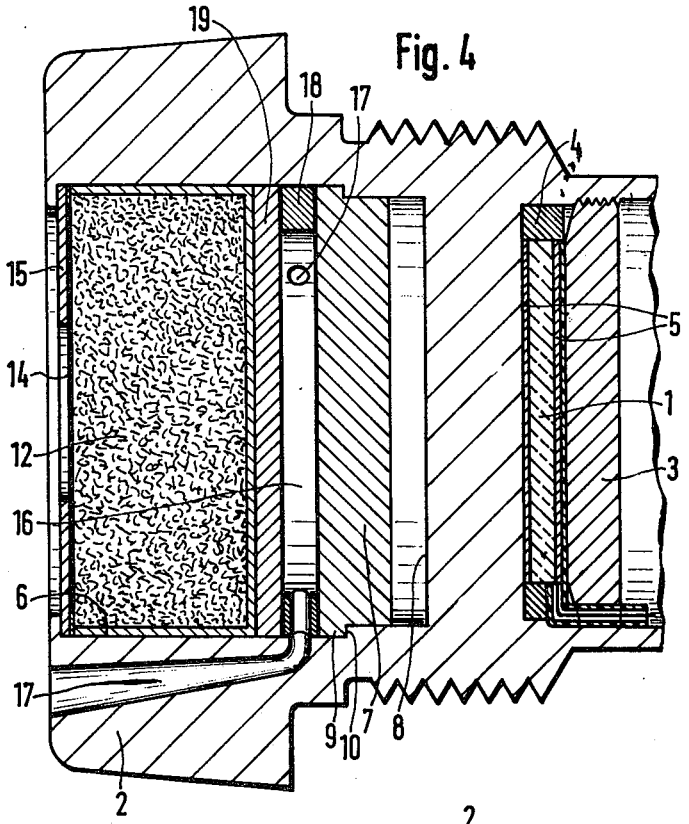
FIG. 4 is a longitudinal section through the corresponding base screw of a further embodiment of a tracer projectile.

According to FIG. 4, between the solid luminescent tracer composition 12 and the rutpute plate 7, in this embodiment, there is located an interspace which is connected with the propellent charge chamber by means of gas inlet passageways 17. The spacing between the rupture plate 7 and the luminescent tracer composition 12 is herein determined through a spacer ring 18 which is broken through in correlation with the outlets of the gas inlet passageways 17. Finally, the rear wall of the luminescent tracer composition 12 is protected by means of a solid plate 19 against the gas pressure which builds up in the interspace 16.

Figure 5:
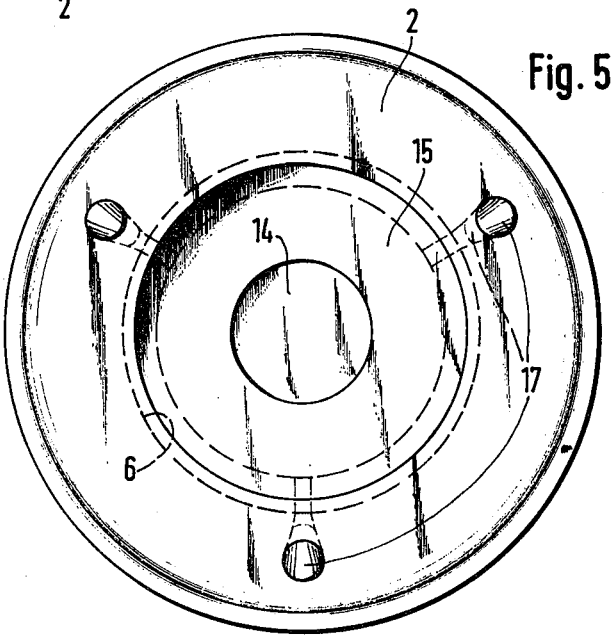
FIG. 5 is a plan view of the base screw of FIG. 4.

According to FIG. 5, the gas inlet passageways 17 are arranged equidistantly about the periphery of the recess 6.

In the last illustrated embodiment, the propellent charge gases extend through the gas inlet passageways 17 into the interspace 16 ahead of the rupture plate 7, from where they load the latter.

I claim:

1. In an electrical projectile detonator, particularly a base detonator; a piezoceramic cell forming a current generator; and a pyrotechnic charge providing a gas pressure for generating a voltage in said cell; the improvement comprising: means for retaining said piezoceramic cell in contact with the interior of the projectile base; and a rupture plate being arranged exteriorly of the projectile base at a spacing from said cell, said rupture plate being subjected to the gas pressure of the projectile propellent charge so as to disintegrate and generate a shockwave in said projectile base for exciting said piezoceramic cell.

2. Electrical projectile detonator as claimed in claim 1, said projectile base comprising a base screw.

3. Electrical projectile detonator as claimed in claim 1 or 2 comprising an intermediate bottom fixed in said projectile base, said piezoceramic cell having the surface thereof facing away from said projectile base in contact with said intermediate bottom.

4. Electrical projectile detonator as claimed in claim 3, said intermediate bottom being screwed into said projectile base.

5. Electrical projectile detonator as claimed in claim 1 or 2, comprising a cup-shaped recess being formed in said projectile base, said rupture plate being arranged in said recess.

6. Electrical projectile detonator as claimed in claim 5, comprising a plurality of axially extending, peripherally spaced pressure-balancing apertures having small cross-sections being spaced about the periphery of said recess.

7. Electrical projectile detonator as claimed in claim 5, comprising a luminescent tracer composition being arranged in said recess in contact with said rupture plate.

8. Electrical projectile detonator as claimed in claim 7, comprising an interspace in said recess intermediate said rupture plate and said luminescent tracer composition; and gas inlet passageways communicating said interspace with the propellent charge chamber of the projectile.

* * * * *